US005529226A

United States Patent [19]

Alberth, Jr.

[11] Patent Number: 5,529,226

[45] Date of Patent: Jun. 25, 1996

[54] SPRAY NOZZLE ATTACHMENT

[76] Inventor: Rudy Alberth, Jr., 13411 Raven Roost, Cypress, Tex. 77429

[21] Appl. No.: 299,553

[22] Filed: Sep. 1, 1994

[51] Int. Cl.[6] ..... B65D 83/30

[52] U.S. Cl. ..... 222/402.1; 222/527; 222/543; 239/588

[58] Field of Search ..... 222/402.1, 402.15, 222/526, 527, 530, 538, 543, 566, 570; 239/337, 588

[56] References Cited

U.S. PATENT DOCUMENTS

| | | | |
|---|---|---|---|
| 865,355 | 9/1907 | Callmann et al. | 239/588 |
| 1,857,969 | 5/1932 | Nelson | 222/527 |
| 2,807,502 | 9/1957 | Tharp | 239/588 X |
| 3,002,695 | 10/1961 | Matthewson | 239/337 X |
| 3,179,290 | 4/1965 | Whitney | 222/571 |
| 3,402,741 | 9/1968 | Yurdin | 239/588 |
| 4,660,745 | 4/1987 | Hess, Jr. | 222/402.15 X |
| 4,858,792 | 8/1989 | de Laforcade | 222/538 X |
| 5,147,075 | 9/1992 | Regan | 222/402.15 |

FOREIGN PATENT DOCUMENTS

| | | | |
|---|---|---|---|
| 1125462 | 8/1968 | United Kingdom | 222/530 |
| 2079183 | 1/1982 | United Kingdom | 239/588 |
| 2218471 | 11/1989 | United Kingdom | 222/402.15 |

*Primary Examiner*—Joseph A. Kaufman
*Attorney, Agent, or Firm*—Conley, Rose & Tayon

[57] ABSTRACT

An apparatus for deploying a pressurized fluid from a pressurized container having a lip and a nozzle head, is disclosed which comprises: a mounting attachment for frictional engagement with the lip, a malleable guide member having proximal and distal guide ends, the proximal guide end being affixed to the mounting attachment, and a flexible tubular member having an internal passage and first and second tube ends, the first tube end being adapted to engage the nozzle head so as to provide continuous fluid passage therewith and the second tube end being affixed to the distal guide end.

16 Claims, 5 Drawing Sheets

SPRAY NOZZLE ATTACHMENT

TECHNICAL FIELD OF THE INVENTION

The present invention relates to a spray nozzle attachment. More particularly, the present invention includes a device that enables pressurized fluids to be applied accurately and easily to relatively inaccessible locations. Still more particularly, the present invention relates to a extension hose directional support for mounting on a pressurized container.

BACKGROUND OF THE INVENTION

Many fluids come in pressurized containers and are designed to be applied by means of a spray nozzle affixed to a valve in the top of the container. Typically, fluid is released by depressing the spray nozzle head, which causes the valve in the top of the container to open, allowing fluid to be released through a fluid passage in the spray nozzle. The spray nozzle head itself can be adapted to release the fluid in a variety of configurations ranging from a fine, dispersed mist to a thin stream. In addition, it is common in some applications to provide a small diameter tube that can be inserted into frictional engagement with the exit opening of the nozzle head. When so mounted, the small diameter tube provides an extension to the nozzle head and allows the fluid stream to be controlled at the exit opening of the tube, rather than at the exit opening of the nozzle head. This allows application of the pressurized fluid into areas where the nozzle head would not provide thorough or accurate application of the fluid. The extension tube is typically provided along with the pressurized fluid container and is commonly affixed to the container by means of an adhesive strip.

Because of the limited usage life of the adhesive strip, it is not practical to store the extension tube with the fluid container for the life of the container. Likewise, it is not practical to store the tube in its mounted position on the nozzle head, because the frictional engagement between the tube and the head is not sufficient to reliably retain the tube. Because the tube itself is so small, it is frequently lost. Furthermore, when the tube is used with the pressurized fluid container, passage of the fluid itself through the tube can cause the tube to disengage from the nozzle head. Alternatively, the tube can be dislodged by inadvertent contact of the tube with other objects. Because the tube is typically used in crowded application areas that are difficult to reach, disengagement of the tube from the nozzle head during use can result in loss of the tube when the dislodged tube falls into an inaccessible area. Hence, it is desired to provide an application tube that is firmly connected to the pressurized container during both spray applications and storage.

Another disadvantage of conventional tube extension is that the tube often becomes coated with a thin layer of the fluid being applied. The presence of this fluid on the outside of the tube prevents use of the adhesive strip for reattachment of the tube to the side of the fluid container. Thus, it is further desired to provide a method for attaching the extension tube to the fluid container without use of adhesive strips.

Because the conventional extension tubes comprise short, rigid tubes, they add little advantage in applying pressurized fluid to hard-to-reach areas. Hence it is further desired to provide a device that will allow application of pressurized fluid to areas that cannot be reached with a conventional straight tube.

There are several instances in which such a flexible remote applicator for pressurized fluid is desired. One is the aviation industry, in which delicate mechanical and electromechanical parts must be frequently checked and cleaned or lubricated. In addition, it is common in the aviation industry to apply corrosion inhibiting compounds (CIC's) to exposed surfaces. Examples of such CIC's include LPS-3® ACF50® and Corrosion X®. The materials from which airplanes and their component parts are made are typically subject to corrosion and must be protected by maintenance of a corrosion inhibiting layer on their surfaces. CIC's are applied during manufacture of the parts, using large expensive bulk applicators. Many CIC's do not last the lifetime of the part to which they are applied, however, and must be reapplied. Because it is not practical for post-manufacture maintenance facilities to operate such large bulk applicators, after manufacturing CIC's are typically applied from small pressurized containers such as aerosol cans. Thus, it is often desired to provide an improved device that allows CIC's to be applied from these cans in an easier and more accurate manner.

The automotive industry is a second area in which it is often desired to apply pressurized fluid remotely and accurately. Pressurized containers can be used in the automotive industry to apply lubricants, degreasers, cleaning fluids or the like. In addition to accessing hard-to-reach spots, it may be desired to apply pressurized fluid to an area of an automobile engine while the engine is hot or running. As automobiles grow more complex, the necessity for accurate remote application increases.

A third industry that could benefit from a device that allows accurate remote application of pressurized fluid is the pest control industry, in which toxic chemicals are frequently used. It is desirable to minimize excess spray of such chemicals, while at the same time ensuring penetration of the chemicals into remote or small areas. Other areas that could benefit from remote accurate fluid application include guns, machinery, and air conditioning equipment. These and other objects and advantages of the invention will appear from the following description.

SUMMARY OF THE INVENTION

The present invention comprises an attachment that can be mounted on the valve rim of a conventional pressurized fluid container and used to deploy the pressurized fluid at locations that may be remote and/or relatively inaccessible. The present invention preferably comprises a mounting clip that snaps onto the container valve rim, a malleable guide member affixed to the mounting clip and a flexible tube that is supported by the guide member and is adapted to connect with the exit opening of the nozzle head. The present invention further comprises an adapter for connecting the flexible tubular member to the nozzle head. When the present spray attachment is snapped onto the container and the flexible tube is connected to the nozzle head, the exit opening of the tube end can be guided accurately to a desired area by bending the guide member and using it to thread the tube in to the desired location. The present invention preferably is removable from engagement with the valve lip, but may be permanently attached to the container in other embodiments.

Alternative embodiments of the present invention comprise support means that can be affixed to the pressure container by various other methods, including snapping a cuff onto the container body or using adhesive to attach a mounting flange to the container body.

BRIEF DESCRIPTION OF THE DRAWINGS

For a detailed description of a preferred embodiment of the invention, reference will now be made to the accompanying drawings wherein.

DETAILED DESCRIPTION OF THE INVENTION

Figure 1:
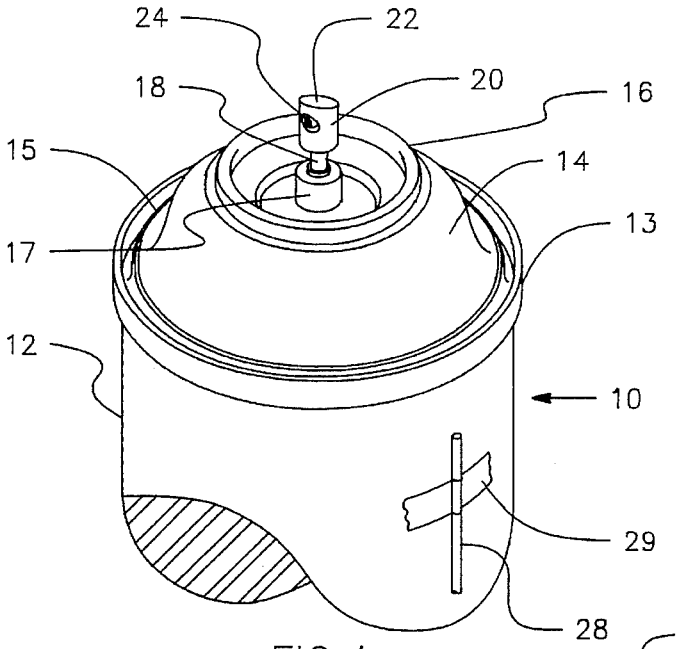
FIG. 1 (PRIOR ART)
FIG. 1 is a perspective view of a conventional pressurized fluid container.

Referring initially to FIG. 1, a typical pressurized fluid container 10 includes a container body 12, a cap 14, and a valve assembly 17. Cap 14 is attached to container body 12 at seam 13. Cap 14 includes a shoulder 15 and an upwardly extending edge (not shown). During manufacture of the container, valve assembly 17 is placed over the upwardly extending edge of cap 14 and crimped so as to form an upper lip 16. Lip 16 is typically rolled or crimped and has a generally rounded outer configuration. Valve assembly 17 controls egress of the fluid from container 10. Extending from valve 17 is a valve stem 18, on which is mounted a spray nozzle head 20. Nozzle head 20 includes a pressure face 22, an inner bore (not shown) and an exit opening 24. Depression of nozzle head 20 opens valve 17, allowing fluid from inside the container to escape through the inner bore and opening 24.

Still referring to FIG. 1, it is not uncommon for pressurized fluid containers of this sort to include a small diameter extension tube 28, which is often affixed to the exterior of container body 12 by means of one or more adhesive strips 29. Extension tube 28 is adapted to be inserted into and frictionally engage opening 24. It is this extension tube that the present invention is intended to replace.

Figure 2:
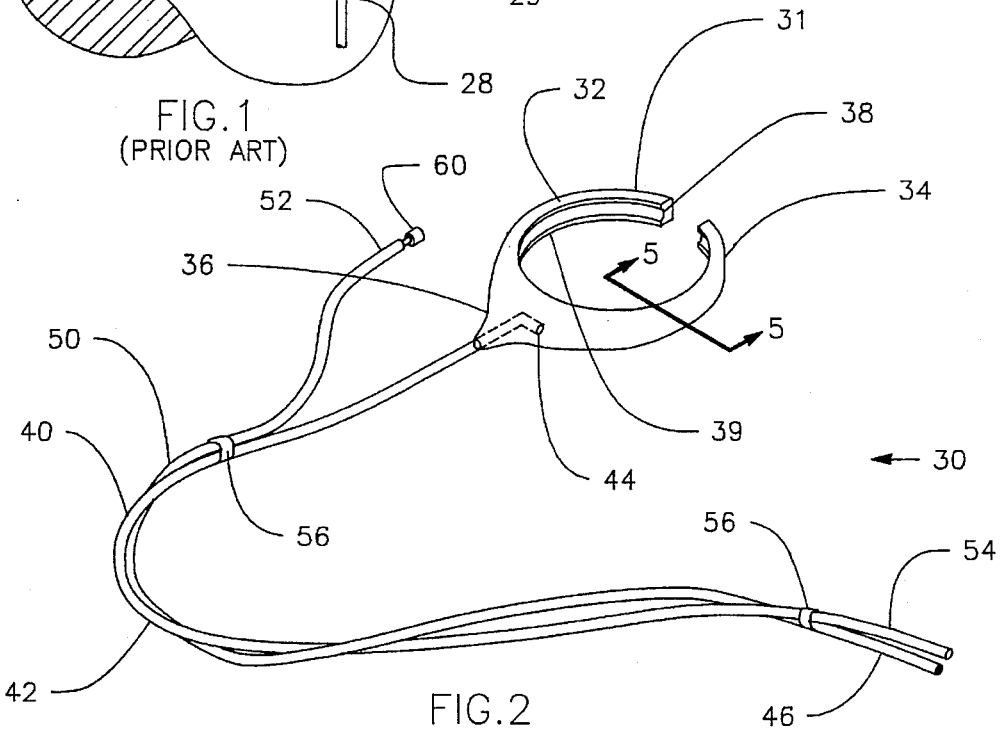
FIG. 2 is a perspective view of a preferred embodiment of the apparatus of the present invention.
Figure 8:
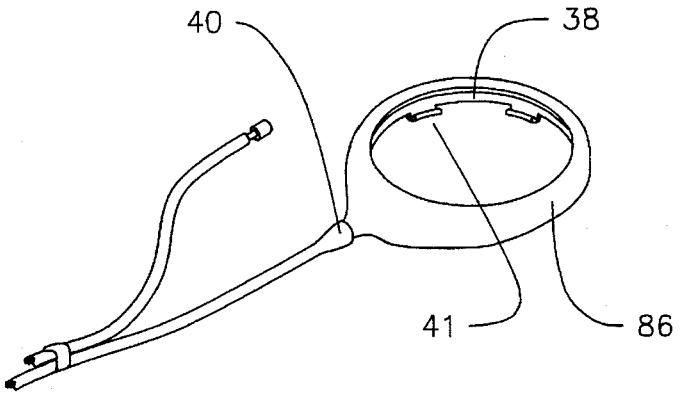
FIG. 8 is a perspective view of a first alternative embodiment of the clip shown in FIG. 2.

Referring now to FIG. 2, a preferred embodiment of the spray nozzle device 30 of the present invention comprises a mounting attachment 31, a malleable guide member 40, and a flexible tube 50. Mounting attachment 31 preferably comprises a generally circular clip 32, which preferably comprises a pair of arcuate arms 33, 34. Between arms 33, 34, clip 32 includes a tapered extension 36. Arms 33, 34 preferably define a continuous arcuate convex inner face 38 and a concave lower lip 39. Inner face 38 is preferably sized and shaped to fit snugly over lip 16 of container 10. Lower lip 39 may be continuous, or may take the form of tabs 41 that engage lip 16 discontinuously, as shown in FIG. 8.

Clip 32 may be constructed of any suitable material and preferably comprises a molded polymer such as nylon, polyurethane, polyvinylchloride (PVC), acrylonitrile-butadiene-styrene (ABS) or the like. Alternatively, clip 32 could be constructed of metal or fiberglass or the like, but it is preferred that the material of clip 32 be non-conducting and slightly elastic, making the preferred polymers particularly suitable. It is preferred that clip 32 be removable from lip 16 and container 10, but there may be instances when it is desirable to size clip 32 so that once it is snapped over lip 16, it engages the lower edge of the valve assembly and is not removable.

Malleable guide member 40 preferably comprises a long wire having a proximal end 44 and a distal end 46. According to a preferred embodiment, proximal end 44 is L-shaped and is embedded in tapered extension 36. End 44 is preferable molded into extension 36 during molding of clip 32, but may be affixed by any other method that results in a strong and durable connection. Guide member 40 is preferably material that is easily plastically deformed and is capable of retaining a desired shape and supporting tube 50. An example of a suitable material is brass or copper wire. Guide member 40 most preferably comprises an insulated wire, such as are well known in the art. By including an electrically insulating layer over support member 40, the likelihood of undesired current in the present apparatus is reduced.

Flexible tube 50 has a proximal end 52 and a distal end 54. Tube 50 is preferably connected to guide member 40 near proximal guide end 44 and again near distal guide end 46 by means of bands 56. Distal tube end 54 preferably extends slightly beyond distal guide end 46. Between bands 56, tube 50 is preferably loosely wrapped around guide 40. It may be preferred to include one or more additional bands 56 along the length of guide 40.

It will be understood that because guide 40 is easily deformable, it can be configured to any desired shape and will support distal end 54 of tube 50 at a desired location in this manner. By loosely wrapping tube 50 around guide 40, tube 50 is prevented from dangling in a manner that might allow it to become entangled with nearby equipment, and is supported in a manner that will not cause the fluid passage therethrough to be closed off by being forced through a tight bend.

Bands 56 may be any suitable material, but are preferably constructed of plastic so as to be non-conducting. Tube 50 may also be any suitably flexible material. It may be desirable to select the material from which tube 50 is constructed on the basis of the pressurized fluid which is to be applied therethrough.

Figure 3:
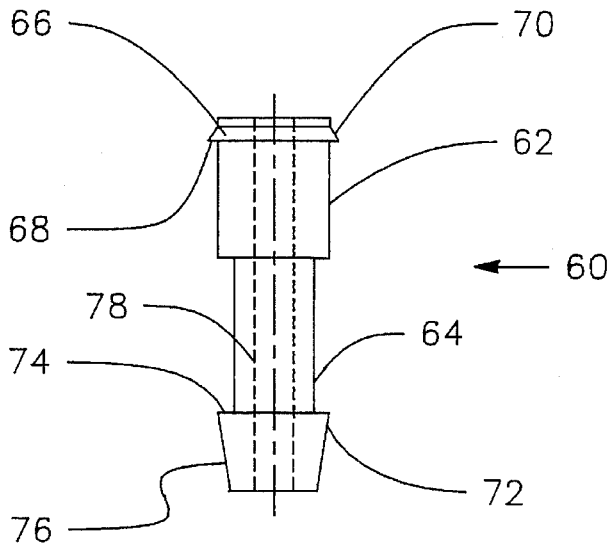
FIG. 3 is an enlarged view of a connector used in the present invention.

As shown in FIG. 2, the proximal end 52 of tube 50 includes a connector 60. As shown in FIG. 3, connector 60 is generally cylindrical and comprises a large diameter portion 62 and a small diameter portion 64. Large diameter portion 62 is preferably sized to be received in exit opening 24 of spray nozzle head 20 and includes a barb 66 thereon. Barb 66 comprises a shoulder 68 and a tapered surface 70. Barb 66 serves to retain connector 60 in nozzle head 20. Likewise, small diameter portion 64 includes a barb 72 having a shoulder 74 and tapered surface 76. Barb 72 frictionally engages inner surface of tube 50 to retain connector 60 therein. Connector 60 has a central passageway 78 therethrough.

It is preferred that large diameter portion 62 of connector 60 engage exit opening 24 of nozzle head 20 in a manner that prevents unintentional disengagement of tube 50 from nozzle head 20 during application of the pressurized fluid, but which allows removal of tube 50 from connector 20 when the pressurized fluid container is not in use.

Figure 4:
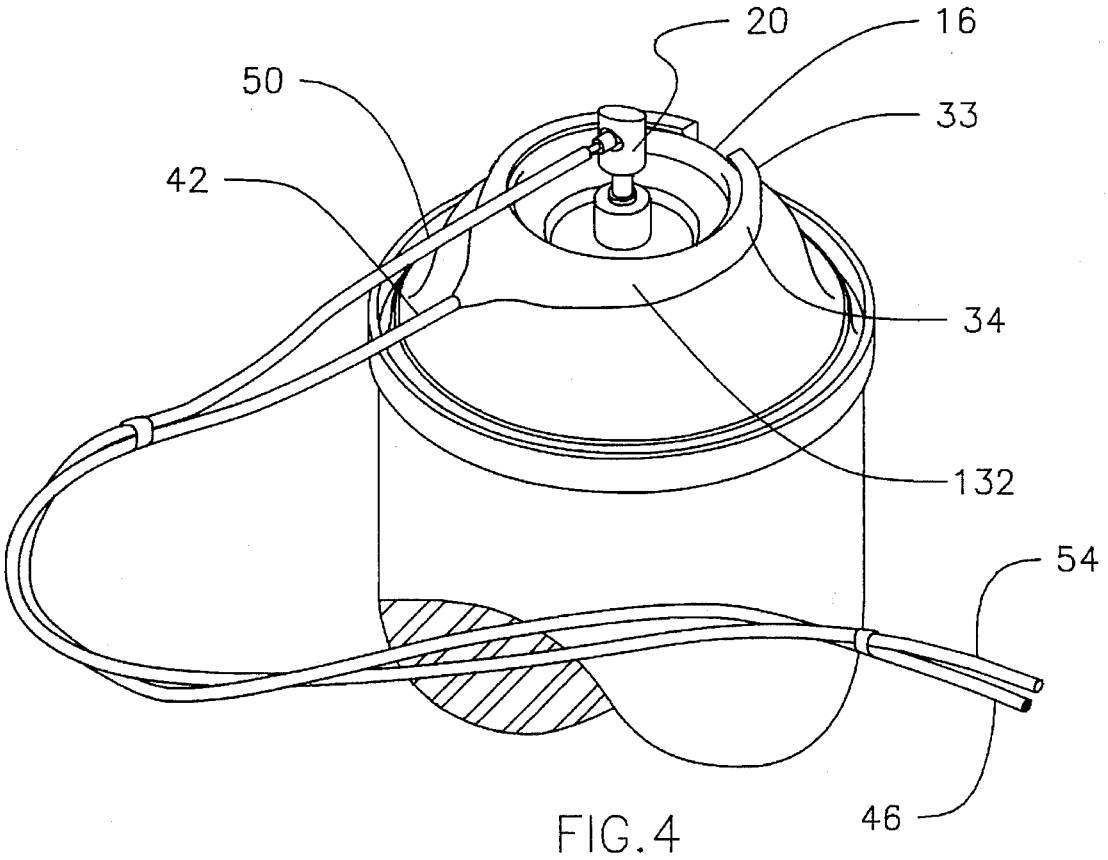
FIG. 4 is a perspective view of the apparatus of FIG. 2 mounted on the pressurized fluid container of FIG. 1.

Referring now to FIG. 4, the spray nozzle device 30 of the present invention is shown snapped onto lip 16 of container 10. Tube 50 is connected to nozzle head 20 by insertion of connector 60 therein. This connection allows a continuous passageway from the interior of container 10 through nozzle head 20, tube 50 and out distal end 54. When nozzle head 20 is depressed, fluid flows through this passageway and is applied in the vicinity of distal end 54. Because guide member 40 is malleable, it can be bent into any desired shape, allowing it to position and support distal end 54 in areas that would otherwise be difficult to access.

Figure 5:
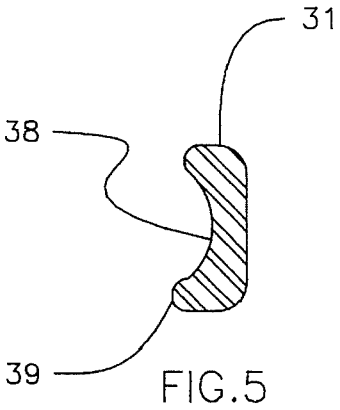
FIG. 5 is a cross-sectional view taken along lines 5—5 of FIG. 2.
Figure 6:
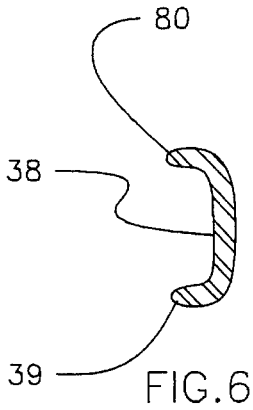
FIGS. 6 and 7 are alternative embodiments of the cross-section shown in FIG. 5.
Figure 7:
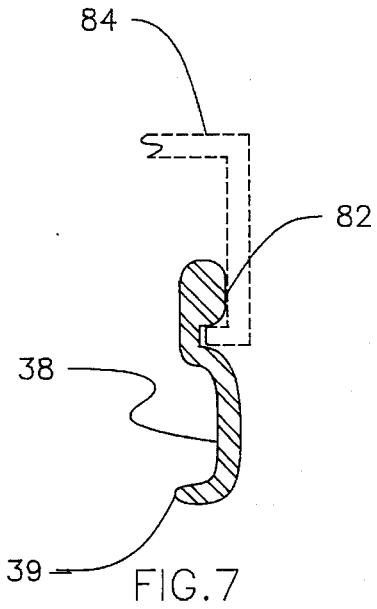

Referring now to FIG. 5, a cross-section of arm 34 is shown. Arm 33 is preferably identical to arm 34. As discussed above, convex inner surface 38 is adapted to fit closely around lip 16. Lip 39 is adapted to engage lip 16 in a manner that prevents detachment of clip 32 from the container. FIG. 6 shows an alternate cross section for clip 32, in which an upper lip 80 extends slightly inwardly over the top of lip 16. FIG. 7 shows a second alternative embodiment, in which the upper edge of clip 32 extends further, to form an upper lip 82. Upper lip 82 preferably echoes the configuration of lip 16, so that a conventional snap-on overcap 84 (shown in phantom) can engage lip 82.

Referring to FIG. 8, an alternative configuration for the mounting attachment is shown. In this configuration, arms 33 and 34 are replaced with a continuous circular clip 86. It has been found preferable to provide a discontinuous clip having arms 33 and 34 so as to allow for slight radial expansion of the clip to facilitate its removal from lip 16. In some instances, it may be desired to provide a clip 86 that irreversibly engages lip 16 and is not removable therefrom. In these instances, clip 86 need not be very elastic. Likewise, it will be understood that if the material from which clip 86 is constructed has sufficient elasticity, it can be provided in a continuous circular form as shown in FIG. 8 without unnecessarily impeding its removal.

It will be understood from the foregoing description that the device of the present invention can be easily attached to a pressurized fluid container by means of the desired mounting attachment 31, after which tube 50 and its guide member 40 will be readily available for use. In the preferred embodiment, the engagement of clip 32 with lip 16 is such that the device will not readily detach from the container unless a deliberate removing force is applied. Once clip 32 has been applied to the container, and tube 50 has been connected to nozzle head 20, pressurized fluid can be applied in many areas that would otherwise be difficult to reach. This is accomplished by bending guide 40 into a desired shape, such that it supports the distal tube end 54 in a desired configuration. When the container is not in use, device 30 can be left in place indefinitely without adverse effects. Alternatively, tube 50 can be disconnected from nozzle head 20 by removing connector 60 form opening 24. In either case, guide 40, and tube 50 with it, can be bent into a convenient configuration such as by wrapping them around the container. When tube 50 is disconnected from nozzle head 20, clip 32 rotates freely around lip 16. When tube 50 connected to nozzle head 20, rotation is limited by tube 50. According to the preferred embodiment, device 30 can be removed from container 10 by disconnecting tube 50 and snapping clip 32 off of lip 16. Because the lips 16 of most small pressurized containers are universally sized, attachment 30 may be re-used indefinitely on multiple fluid containers.

Figure 9:
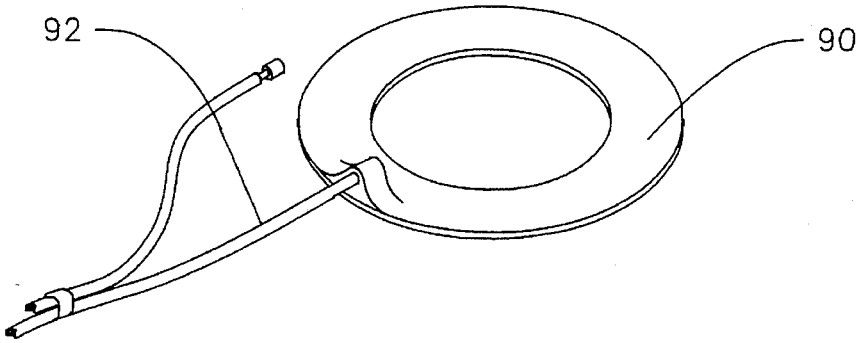
FIG. 9 is a perspective view of a second alternative embodiment of the clip shown in FIG. 2.

Referring now to FIG. 9, a second alternative embodiment of the present device comprises a rigid ring 90, to which a guide member 92 is affixed. Guide member 92 is attached to ring 90 such as by soldering or welding if ring 90 is plastic, or by molding guide 92 into ring 90 if ring 90 is plastic. Guide member 92 supports a flexible tube 94. Ring 90 preferably is thin in its axial direction and has an inside diameter only slightly larger than the neck of a conventional pressurized container. According to this embodiment, ring 90 is slipped over the neck of container 10 during manufacture of the container, before the valve assembly is crimped onto the top of container 10. When the valve assembly is applied to the container and crimped so as to seal the top of the container, the interface between the valve and cap 14 forms lip 16.

Figure 10:
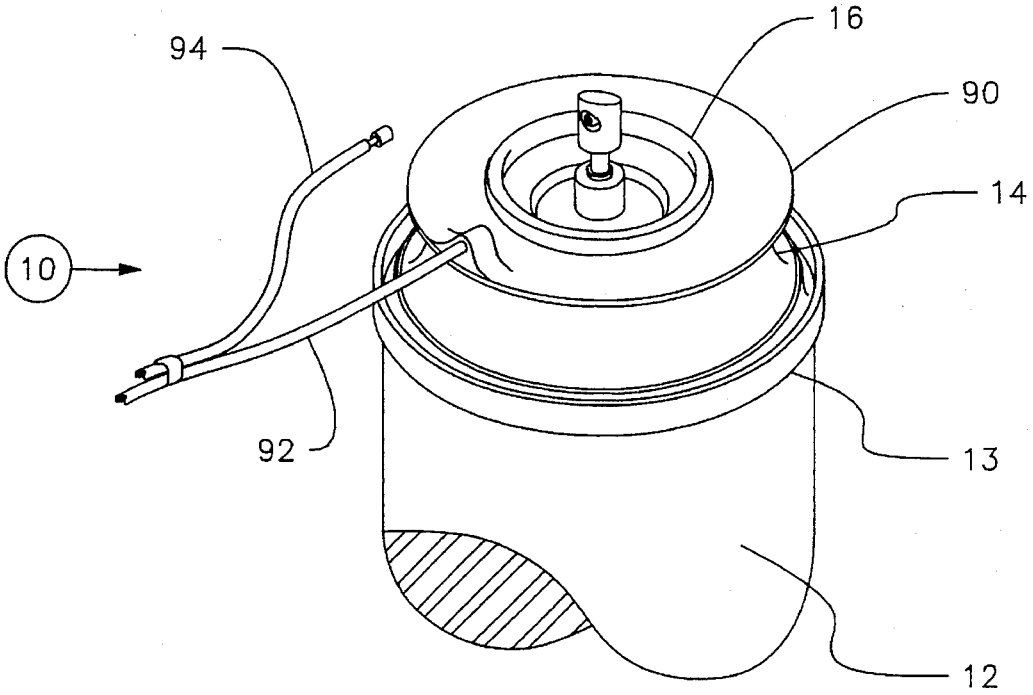
FIG. 10 is a perspective view of the clip of FIG. 9 attached to a pressurized container.

In this embodiment, ring 90 is held in place on container 10 by lip 16, as best shown in FIG. 10. Ring 90 is not removable, but is free to rotate about the cap 14. This embodiment provides a permanently attached guide, and still allows the flexible tube 94 to be disconnected from the spray nozzle head as described above.

Figure 11:
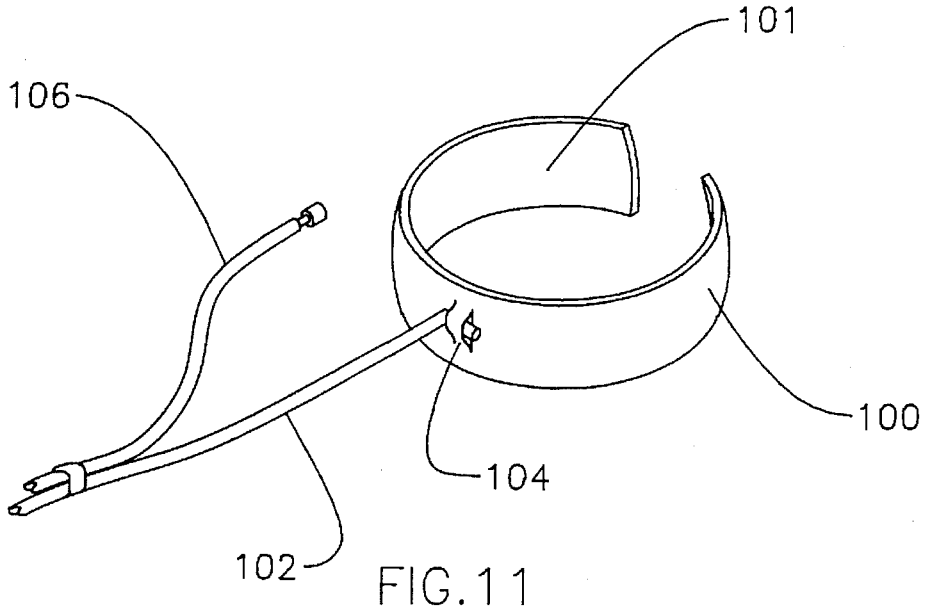
FIG. 11 is a perspective view of a third alternative embodiment of the clip shown in FIG. 2.

Referring now to FIG. 11, a third alternative embodiment of the attachment of the present invention comprises a rigid arcuate cuff 100 having an inner surface 101 that is sized to conform closely to the circumference of the container body 12. Cuff 100 preferable has sufficient elasticity to allow it to be snapped on to the exterior of container body 12 and then to maintain a snug fit thereon. Cuff 100 may comprise plastic or metal. A guide 102 is mounted on cuff 100, preferably by creating an L-shaped bend 104 in the proximal end of guide 102 and attaching it by any suitable means, such as soldering or welding or molding guide 102 into cuff 100. It will be understood that cuff 100 can be modified to engage container 10 over a smaller area and/or to be affixed to container 10 by means of an adhesive applied to inner surface 101. In any event, it is preferred that the connection between the guide member, the container attachment and the container be such that the guide member is supported by the attachment in a manner that does not allow undesired movement of the guide relative to the container.

Although the present fluid dispensing mechanism is preferred to be the combination of malleable guide member and flexible tube described above, it will be understood that a selfsupporting tube could be used in place of this combination. An example of such self-supporting tubing comprises a series of linked ball and socket members having a continuous fluid passage therethrough, such as are available under from the Cedarburg corporation of Minnesota under the name Snap-loc™ and from Lockwood Products of Oregon under the name Loc Line™.

Figure 12:
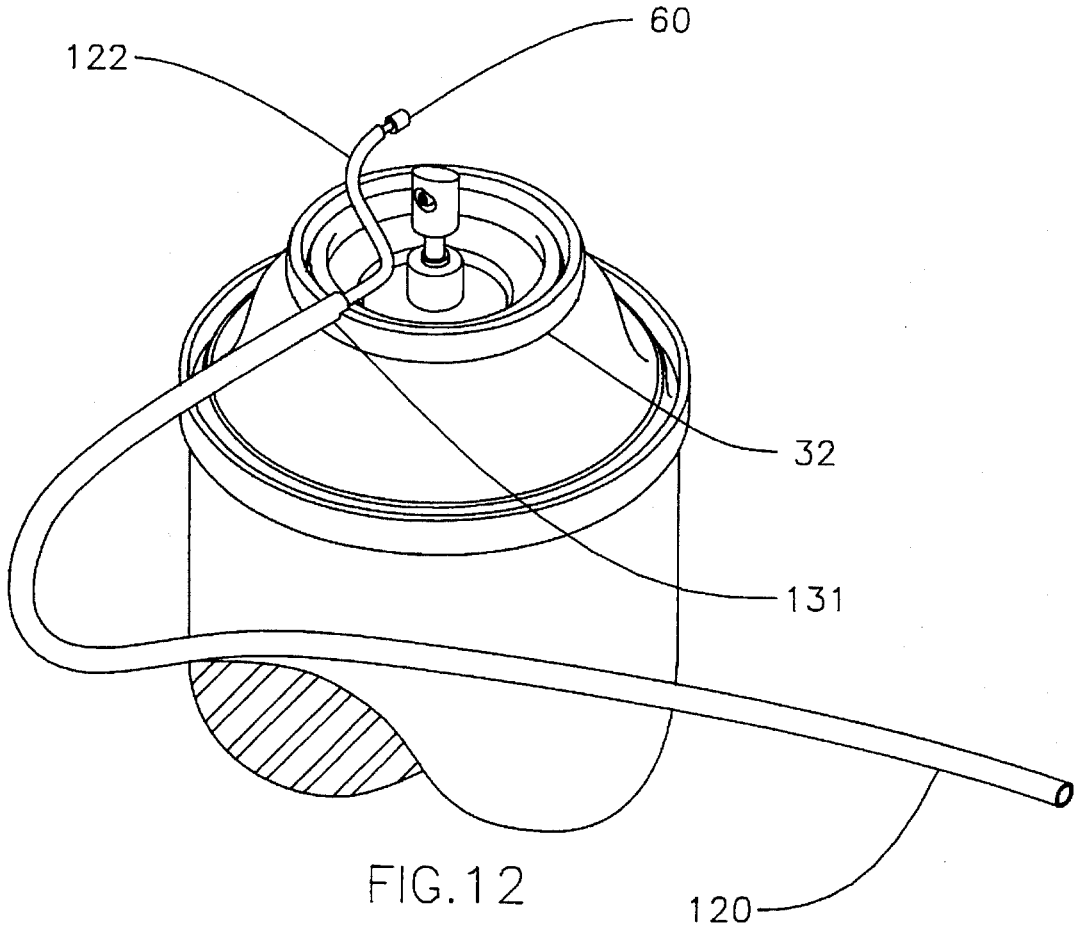
FIG. 12 is a perspective view of a fourth alternative embodiment of the clip shown in FIG. 2.

Other types of self-supporting tubing may be used, but some types, such as brass or copper tubing may tend to buckle when bent, thereby compromising the integrity of its fluid passage. If the tubing is selected to be self-supporting, the guide member may be omitted from the device. Such a device is illustrated in FIG. 12, wherein a mounting clip 132 supports a length of self-supporting tubing 120. Self-supporting tubing 120 is shown in an interference fit with a groove 131 in clip 132, but may be mounted on the desired mounting attachment by any suitable means. Self-supporting tubing 120 may receive connector 60 for engagement with spray nozzle head 20, or it may receive a short length of flexible tubing 122, which in turn receives a connector 60, as shown.

If necessary, the present device can be used in conjunction with a horoscope or similar small camera, so that the user can use visual feedback from the perspective of the tube end to guide the device into place.

While a preferred embodiment of the invention has been shown and described, modifications thereof can be made by one skilled in the art without departing from the spirit of the invention.

What is claimed is:

1. An apparatus for deploying a pressurized fluid from a pressurized container having a nozzle head, comprising:

a mounting attachment capable of maintaining a supporting engagement with the container without engaging said nozzle head;

a malleable guide member having proximal and distal guide ends, said proximal guide end being affixed to said mounting attachment; and a flexible tube having an internal passage and first and second tube ends, said first tube end being adapted to engage the nozzle head so as to provide a continuous fluid passage therewith and said second tube end being affixed to said distal guide end, said guide being outside of said tube.

2. The apparatus according to claim 1 wherein said tube is affixed to said guide member near its first tube end.

3. The apparatus according to claim 1 wherein said mounting attachment comprises a pair of arcuate arms.

4. The apparatus according to claim 1 wherein said mounting attachment comprises a ring.

5. The apparatus according to claim 1 wherein said mounting attachment comprises a molded polymer.

6. The apparatus according to claim 1 wherein said guide member and said tube are connected by means of a plurality of bands.

7. The apparatus according to claim 1 wherein said proximal guide end is embedded in said mounting attachment.

8. The apparatus according to claim 1 wherein said mounting attachment is frictionally retained on the container.

9. The apparatus according to claim 1 wherein said mounting attachment is mechanically retained on the container.

10. The apparatus according to claim 1 wherein said mounting attachment is removable from the container.

11. The apparatus according to claim 1 wherein the container includes a lip and said mounting attachment engages said lip.

12. The apparatus according to claim 11 wherein said mounting attachment snaps onto said lip and is removable therefrom.

13. The apparatus according to claim 11 wherein said mounting attachment is installed on the container before formation of said lip and is mechanically retained by said lip.

14. The apparatus according to claim 1 wherein the container includes a container body and said mounting attachment engages said container body.

15. The apparatus according to claim 14 wherein said mounting attachment is affixed to said container body by means of adhesive.

16. A device for controlling the application of fluid from a pressurized container having a spray nozzle head and a lip, comprising:

a removable mounting clip capable of being snapped into engagement with the lip and maintaining a supporting engagement with the container lip;

a malleable guide member having proximal and distal guide ends, said proximal guide end being affixed to said clip so as to avoid undesired movement of said guide with respect to said clip; and a flexible tube having an internal passage and first and second tube ends, said first tube end being adapted to engage the nozzle head so as to provide a continuous fluid passage therewith and said second tube end being affixed to said distal guide end, said flexible tube being loosely wrapped around said guide, said guide being external of said tube.

* * * * *